United States Patent [19]

Nyberg

[11] 4,416,117

[45] Nov. 22, 1983

[54] THERMALLY PRODUCING A HIGH-SPEED ATOMIZED LIQUID JET

[76] Inventor: Johan E. Nyberg, 18 Kyrkogatan, S-981 00 Kiruna, Sweden

[21] Appl. No.: 226,700

[22] Filed: Jan. 21, 1981

[30] Foreign Application Priority Data

Feb. 1, 1980 [SE] Sweden ..... 8000826

[51] Int. Cl.[3] ..... F01K 25/02

[52] U.S. Cl. ..... 60/650; 60/651

[58] Field of Search ..... 60/650, 682, 530, 531, 60/651, 671

[56] References Cited

U.S. PATENT DOCUMENTS 3,055,170 9/1962 Westcott, Jr. ..... 60/682
4,027,483 6/1977 Wahl ..... 60/650
4,228,659 10/1980 Lowther ..... 60/682
4,255,934 3/1981 Stephenson ..... 60/682 X

*Primary Examiner*—Allen M. Ostrager
*Assistant Examiner*—Stephen F. Husar
*Attorney, Agent, or Firm*—Burns, Doane, Swecker & Mathis

[57] ABSTRACT

The present invention relates to a method of thermally producing a flow of a working medium, especially for driving turbines and the like. The working medium is heated to a predetermined temperature in a closed space at a pressure, which is higher than the steam formation pressure of the working medium at the predetermined temperature, and in liquid phase in the form of a jet atomized in droplets is tapped in a controlled flow from the closed space through one or more outflow nozzles and against a lower pressure.

4 Claims, 3 Drawing Figures

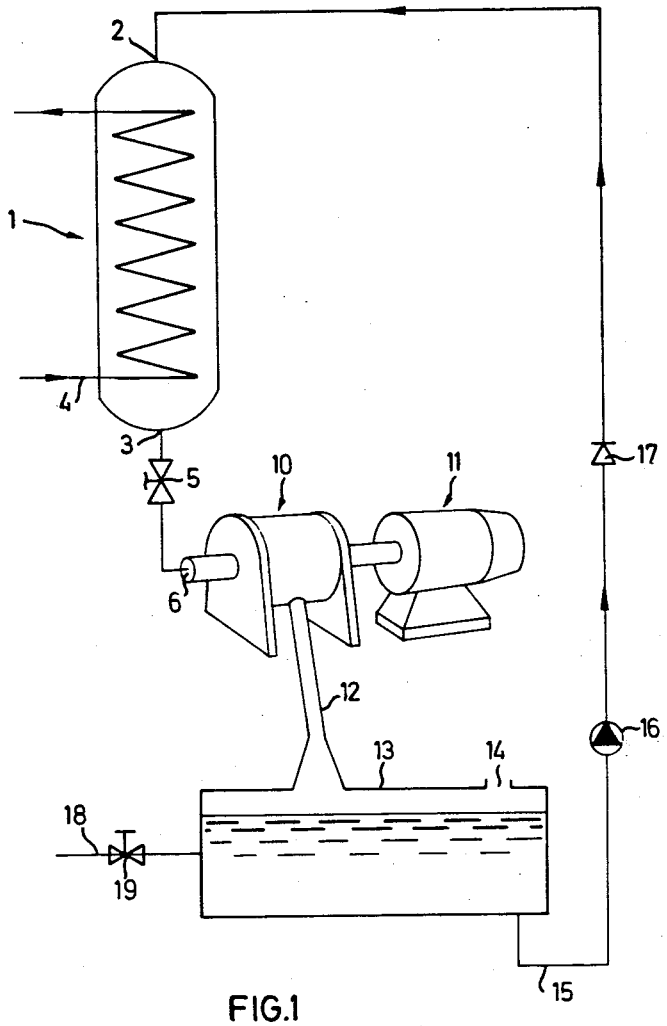
FIG.1
FIG. 3
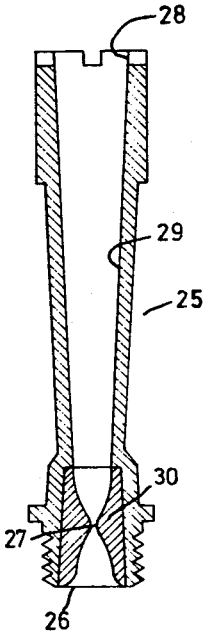

THERMALLY PRODUCING A HIGH-SPEED ATOMIZED LIQUID JET

BACKGROUND AND SUMMARY OF THE INVENTION

This invention relates to a method of producing thermally a flow of a working medium, especially for the operation of a turbine or the like.

In steam turbines it is necessary, for achieving a satisfactory efficiency degree, to condense the operation steam tapped from the turbine to liquid phase, which thereafter by a feed pump is recycled to the boiler.

The invention has particularly the object to provide an energy machine in the form of a turbine, which operates with the reaction force from a thermally produced high-speed atomized liquid jet, the steam phase in which is so small that no condenser is required.

The invention is based on the idea, that water, which is heated to a high temperature and a pressure corresponding to the temperature without boiling, is tapped through an outlet passageway to an outflow nozzle of suitable form and size so that the medium flows out to an ambient or low pressure in the form of a very rapid jet of very small droplets, which spray jet has a surprisingly low temperature and also surprisingly is substantially free of steam.

The major part of the heat supplied to the working medium is retrieved in the spray jet as kinetic energy of the droplets, and a very small part of the heat is bound as steam formation heat in the jet.

The inventor has carried out an extensive series of experiments with a simple experimental arrangement. It comprised an electrically heated cylindrical boiler with a vertical axis. The boiler was upwardly provided with a filler opening with screw lock and downwardly with a drain passageway to a governor valve and a horizontally directed outlet nozzle. The boiler was upwardly pivotally suspended on a horizontal shaft, and the nozzle was held by a dynamometer, at which the reaction force of the spray jet could be read directly. A manometer indicated the pressure in the boiler, and a well-calibrated thermometer, one soldered joint of which was immersed in melting ice, indicated the temperature in the mouth of the outlet nozzle.

The drain passageway had a diameter of about 10 mm, and a length of about 70 mm. The smallest cross-section of the nozzle was about 2 $mm^2$, and its outlet cross-section was 200 $mm^2$, with a cone angle of about 10°.

The boiler held about 1 liter and was at the experiments filled with only about 0.7 liter water, in order to prevent the risk that the boiler would hydraulically burst due to the water expansion at heating.

During a typical experiment heat was supplied until the manometer indicated about 86 bar, which corresponds to a power water temperature of about 300° C.

The opening of the governor valve resulted immediately in a forceful spray jet of atomized water of high speed. For 6–7 seconds, i.e. until the boiler was emptied, an almost constant reaction force of about 100 N from the jet was read. The temperature read in the nozzle aperture was at the same time 35°–40° C. No steam cloud about the jet was observed. By bare hand the temperature about half a meter downstream of the nozzle in the jet was judged to be 30°–35° C. The jet wetted the hand. From data and measured values the outlet spread of the jet was calculated to be about 1000 m/s.

The impulse of the jet from the nozzle can be utilized, for example, for driving a turbine of known type, either as a reaction turbine with the nozzles arranged on the turbine wheel, or as an action turbine with the nozzles fixed in the turbine housing. The invention can be said to be characterized in that the working medium is heated to desired temperature in a closed space at a pressure, which is higher than the steam formation pressure of the working medium at the desired temperature, and that the working medium in liquid phase is tapped and passed to one or more outflow nozzles against lower pressure.

Due to the fact that according to the invention the working medium after the turbine is in liquid phase, it is possible to produce thermally an atomized liquid jet even at low temperatures by a working medium with properties adapted thereto. The heat source can be of known kind. Especially when using a volatile working medium operating at low temperatures, however, it can be the condenser side of a heat pump circuit, which takes up heat at low temperature from a natural heat supply, for example the sea, and emits the heat at higher temperatures to the heat source.

BRIEF DESCRIPTION OF THE DRAWINGS

The invention is described in the following by way of an embodiment and with reference to the accompanying drawings, in which FIG. 1 is a schematic view of a basic design of a turbine plant according to the invention intended especially for water as working medium, FIG. 3 is a schematic view of an outlet nozzle for the working medium in the turbine.

DETAILED DESCRIPTION OF THE PREFERRED EMBODIMENT

Figure 2:
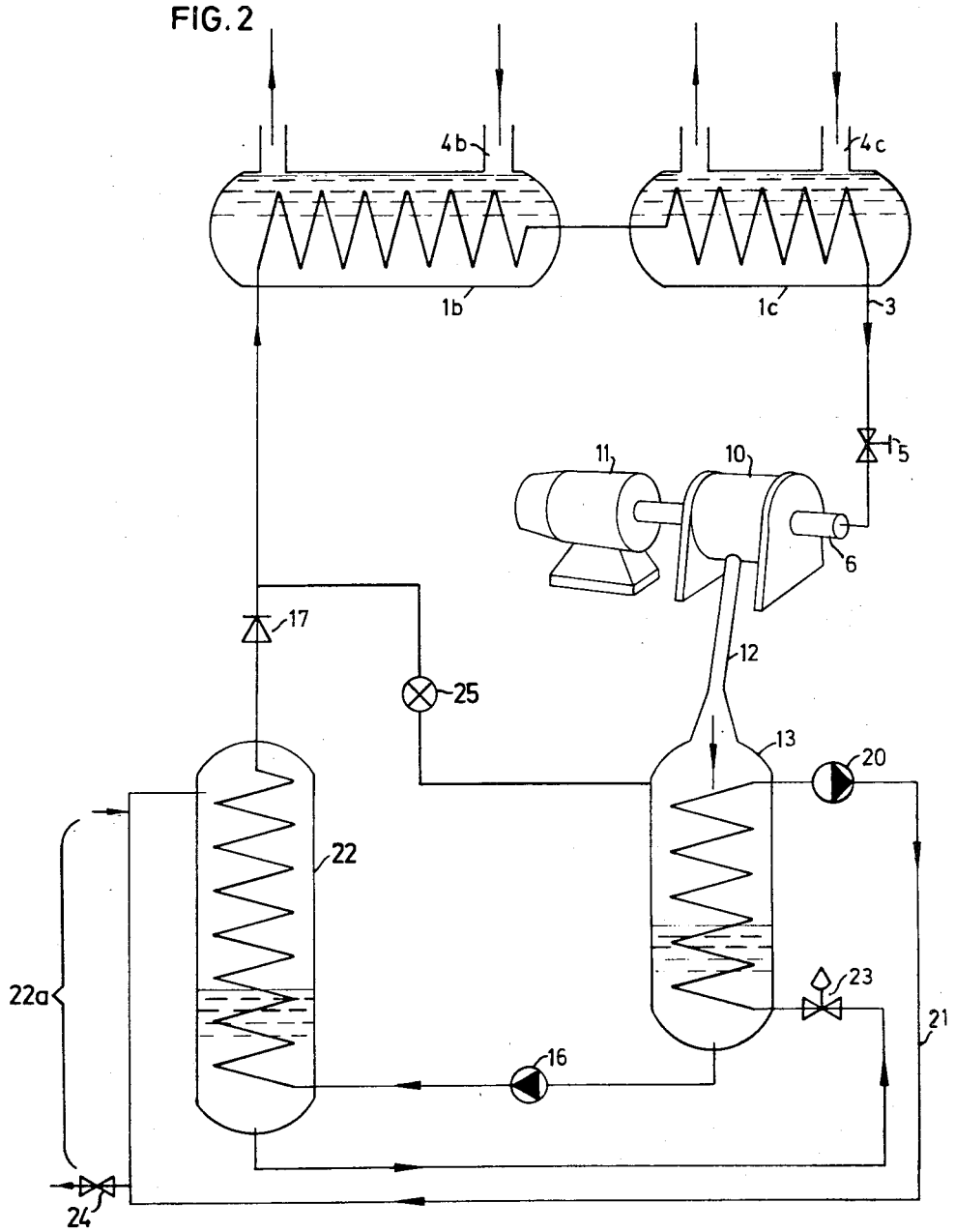
FIG. 2 is a second embodiment of the invention intended especially for volatile working media.

The turbine plant shown in FIG. 1 comprises a closed space 1 with an inlet 2 for feed water and an outlet 3 for hot power water. The boiler 1 is designed as a cylindric shell with almost half-spherical end walls. In the boiler a heat source in the form of a coil 4 for, for example, hot fuel gas, steam or the like is provided. The outlet 3 opens into a drain passageway, in which a governor valve 5 is located for shutting off and controlling the flow of the power water in the drain passageway, which continues to a shaft lead-through 6 in a turbine 10. The turbine 10 preferably is a reaction turbine, in which the working medium from the shaft lead-through 16 is passed out in a wheel to outflow nozzles of the type shown in FIG. 3 which are located peripherically and directed tangentially. The turbine 10 comprises a turbine housing, which encloses the turbine wheel for collecting the water sprayed out of the nozzles to a discharge conduit 12, which opens into a receiver vessel 13. From the receiver vessel 13 a feed conduit 15 extends to a feed pump 16 and, possibly via a non-return valve 17, back to the inlet 2 of the boiler 1. (11 designates a generator).

The receiver vessel 13 has the object to balance occasional differences in the flows through the turbine 10 and, respectively, feed pump 16.

The water spray in the turbine 10 being cool and substantially free from water steam, as FIG. 1 shows, no condensor is required for restoring water in gaseous phase to liquid phase. The receiver vessel 13, instead, is suitably ventilated to the atmosphere by an opening 14, so that atmospheric pressure prevails in the vessel 13 as well as substantially in the outlet conduit 12 and in the turbine housing.

For replacing water losses, a filler pipe 18 is provided including a valve 19 possibly controlled by the liquid level in the vessel 13.

The turbine plant in FIG. 2 comprises the same basic components as the plant shown in FIG. 1, but is intended for working media operating between relatively low temperature limits. The plant, therefore, is designed as a closed system. In FIG. 2 identical components have been given the same designations as in FIG. 1.

The closed space, in which the working medium is heated, is divided into two parts 1*b* and 1*c*, through which the working medium flows and is heated by a heat medium from a heat circuit 4*b* and, respectively, 4*c*. The pressure in the circuit of the working medium is higher than the vaporizing pressure for the medium at the temperature prevailing in the space, whereby boiling of the working medium is prevented. The final temperature of the working medium thereby is lower than its critical temperature, so that the working medium at the outlet 3 is tapped in liquid phase. The flow of the working medium through the turbine 10 which, for example, drives the turbine is controlled by the governor valve 5. The liquid spray tapped from the turbine 10 is collected in the receiver vessel 13, which contrary to the corresponding vessel in FIG. 1 is closed, in order to permit in the vessel 13 a pressure independent of the atmospheric pressure. A feed pump 16 presses the working medium from the receiver vessel 13 via a non-return valve 17 again to the space 1*b*, 1*c*.

As one example only of a working medium for the circuit shown can be mentioned carbonic acid, which is allowed to work, for example, between the temperature limits +31° C.—−30° C. The heating in the space 1*b*,1*c* can be effected directy by solar energy or, for example, warm waters (tropic water and the like). When the available temperature during certain periods is not sufficiently high, the heating can be effected by a connected heat pump. Therefore, the closed space is divided into two parts 1*b*,1*c*. However, as temperatures as low as −30° C. normally are not available, it is necessary to effect the cooling of the liquid spray after the turbine 10 by a cooling circuit. According to FIG. 2 this circuit in principle consists of a heat pump, which by means of the evaporator 21 takes up the heat in the spray and transports it to the working medium after the pump 16, where the heat is emitted in a condensor 22. The heat pump includes a compressor 20 and a throttle valve 23.

At steady condition the liquid spray after the compressor is cooled to −30° C., in that it emits its heat to the circuit of the heat pump, which heat is supplied to the working medium in the condensor 22. Due to the fact that the temperature of the working medium after the pump 16 substantially is equal to the temperature before the pump 16, the heat pump operates in a relatively small temperature interval, so that the energy supply required for the heat pump is low. The compressor 20 preferably is driven by the generator 11.

The condensor 22 has at the start not sufficient condensing capacity, and therefore an additional condensor 22*a* is connected to the heat pump circuit via a valve 24, as appears from FIG. 2.

The working medium being carbonic acid, the coolant in the heat pump circuit preferably can be ammonia.

When the plant according to FIG. 2 is being started, the governor valve 5 must be closed, and the turbine 10 and receiver vessel 13 be cooled to −30° C. via the cooling compressor 20 in the heat pump circuit, in which the valve 24 is open.

The throttle valve 23 controls the temperature in the receiver vessel 13. When the temperature has dropped to −30° C. in the receiver vessel 13, and the temperature of the working medium in the spaces 1*b* and 1*c* has assumed the desired value, the valve 24 shall be closed, the governor valve 5 be opened fully, and the circulation pump 16 be started. Thereby, the turbine 10 is started.

The system includes further a safety valve 25.

FIG. 3 shows a reaction nozzle 25 for water spray which is suitable for use in connection with the invention. The water spray is intended to drive the turbine 10. The nozzle 25 has an inlet 26, the downstream cross-section of which decreases to a constriction 27 and thereafter widens to an outlet 28. Typically, the cone angle along the greater part of the outlet portion 29 is about 10°, and the ratio between the outlet area and the constriction area is of the magnitude 100:1. In view of the wearing action of the water, the inlet portion can be made of a harder and more resistant material in an insert portion 30 than in the remaining part of the nozzle 25.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressely intended that all such variations and changes which fall within the spirit and scope of the present invention as defined in the claims be embraced thereby.

What is claimed is:

1. A method of thermally producing a flow of a working medium, especially for driving turbines and the like, the method comprises heating the working medium to a predetermined temperature in a closed space at a pressure, maintaining said pressure at a value exceeding the steam formation pressure of the working medium at said temperature such that the working medium is in liquid phase, tapping a controlled flow from the closed space, passing the liquid flow through at least one outflow nozzle against lower pressure to form a jet of atomized small droplets of liquid.

2. The method as defined in claim 1, wherein the working medium is water, and the lower pressure is atmospheric pressure.

3. The method as defined in claim 1, wherein the working medium is a substance more volatile than water, and further comprising producing the flow of working medium in a closed circuit, cooling the working medium after having emitted its energy in an evaporator included in a heat pump circuit, and emitting the heat taken up in the evaporator of the heat pump circuit to the working medium in the closed space through a condensor of the heat pump circuit.

4. The method as defined in any one of claim 1, claim 2 or claim 3, further comprising collecting the working medium after the working medium has emitted its energy in a receiver vessel for balancing the liquid flow.

* * * * *